US008793905B2

(12) United States Patent
Barthel

(10) Patent No.: US 8,793,905 B2
(45) Date of Patent: Aug. 5, 2014

(54) SKI BOOT AND BINDING SYSTEM COMPRISING A SKI BOOT AND A SKI BINDING

(75) Inventor: Fritz Barthel, Bad Häring (AT)

(73) Assignee: Salewa Sport AG, Herisau (CH)

( * ) Notice: Subject to any disclaimer, the term of this patent is extended or adjusted under 35 U.S.C. 154(b) by 489 days.

(21) Appl. No.: 12/984,863

(22) Filed: Jan. 5, 2011

(65) Prior Publication Data

US 2011/0271557 A1 Nov. 10, 2011

(30) Foreign Application Priority Data

Jan. 5, 2010 (DE) ..... 20 2010 000 614 U

(51) Int. Cl.

| | |
|---|---|
| ***A43B 5/04*** | (2006.01) |
| ***A63C 9/08*** | (2012.01) |
| *A63C 9/086* | (2012.01) |
| *A63C 9/085* | (2012.01) |

(52) U.S. Cl.

CPC ..... *A43B 5/0423* (2013.01); *A63C 9/0807* (2013.01); *A63C 9/086* (2013.01); *A63C 9/08535* (2013.01)

USPC ..... 36/117.1; 36/115

(58) Field of Classification Search

CPC ..... A43B 5/04; A43B 5/0423; A63C 9/0807; A63C 9/086; A63C 9/08535; A63C 9/08564; A63C 9/08528

USPC ..... 36/117.1–117.3, 115, 116; 280/613, 280/623

See application file for complete search history.

(56) References Cited

U.S. PATENT DOCUMENTS

| | | | | |
|---|---|---|---|---|
| 3,826,022 | A * | 7/1974 | Grzech | 36/117.3 |
| 4,348,036 | A * | 9/1982 | Settembre | 280/615 |
| 6,957,827 | B2 | 10/2005 | Kogler | |
| 7,320,474 | B2 * | 1/2008 | Quellais et al. | 280/615 |
| 2008/0184599 | A1 * | 8/2008 | Ekberg | 36/117.3 |
| 2010/0257754 | A1 * | 10/2010 | Trabucchi | 36/117.1 |

FOREIGN PATENT DOCUMENTS

| | | | |
|---|---|---|---|
| EP | 0199098 | B1 | 10/1986 |
| EP | 1 224 958 | A1 | 7/2002 |
| EP | 1559457 | A1 * | 8/2005 |
| FR | 2 945 185 | A1 | 11/2010 |
| WO | 97/41931 | A1 | 11/1997 |

OTHER PUBLICATIONS

European Search Report in corresponding EP 11 15 0232 dated May 3, 2011, 7 pages.

* cited by examiner

*Primary Examiner* — Jila M Mohandesi
(74) *Attorney, Agent, or Firm* — Rothwell, Figg, Ernst & Manbeck, P.C.

(57) ABSTRACT

The invention provides a ski boot (12) which comprises an opening (18*a*, 18*b*) in each of opposing lateral, front boot portions, the openings (18*a*, 18*b*) defining an opening axis (Q) along which bearing bolts (32*a*, 32*b*) of a ski binding (14) may be introduced into the openings (18*a*, 18*b*), in order to hold the ski boot (12) on the ski binding (14) such that it can pivot about the opening axis (Q), at least one of the openings (18*a*, 18*b*) comprising at least one inner bearing portion (42) for bearing against an outer circumferential portion (50) of the bearing bolt (32*a*, 32*b*), the bearing portion (42) allowing displacement of the bearing bolt (32*a*, 32*b*) in the direction of the opening axis (Q) and a pivoting movement of the bearing bolt (32*a*, 32*b*) about the opening axis (Q), but substantially preventing displacement or a pivoting movement of the bearing bolt (32*a*, 32*b*) in other directions.

14 Claims, 5 Drawing Sheets

SKI BOOT AND BINDING SYSTEM COMPRISING A SKI BOOT AND A SKI BINDING

Figure 1:
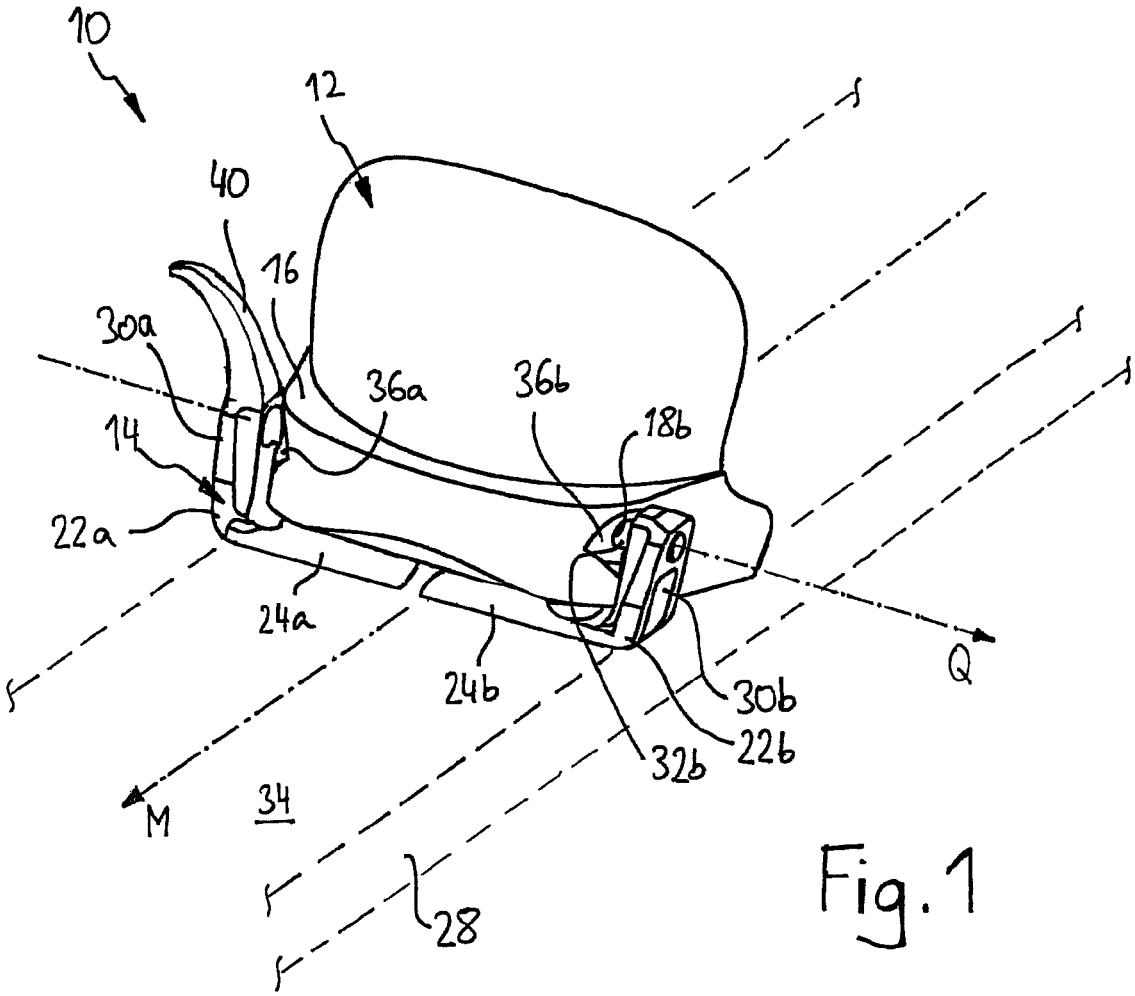

The present invention relates to a ski boot, which comprises an opening in each of opposing lateral, front boot portions, the openings defining an opening axis along which bearing bolts of a ski binding may be introduced into the openings, in order to hold the ski boot on the ski binding such that it can pivot about the opening axis. In addition, the invention relates to a binding system comprising such a ski boot and a ski binding. The invention finds particular application in the field of ski touring, being especially advantageous for ski touring races. For the purposes of the present invention, however, the term "ski" also covers split boards, i.e. snowboards which can be separated lengthwise, the individual parts of which may be used like skis to ascend slopes.

In ski touring a binding system has become established which holds the ski boot pivotably about a pivot axis orthogonal to the ski axis using two lateral bearing bolts of a touring ski binding, bearing bolts being inserted into corresponding lateral openings in the ski boot. A ski boot of the above type with a corresponding binding system is disclosed for example in EP 0 199 098 A2. The lateral openings provided in the ski boot take the form of conical recesses, such that they are conformed to the conical tips of the bearing bolts and allow the bearing bolt both to slide easily into the opening when getting into the binding and to slide out on release of the binding, i.e. detachment of the ski boot, in the case of a fall.

During an ascent, when the ski binding is in ski touring mode, such that a heel fastener system releases the heel of the ski boot and the ski boot can pivot about the bearing bolts, release of the front jaw is generally undesirable. In ski touring mode, a ski brake is frequently deactivated, such that loss of the ski entails the risk of the ski sliding away down the slope. In racing, unintentional release of the front jaw additionally means lost time. To prevent release of the binding during an ascent, it is known to lock the front jaw in the touring position, wherein clamping levers, which bear the bearing bolts, are blocked by a locking lever in such a way that they cannot be moved even if the binding is loaded in the transverse direction and the bearing bolts cannot slide out of the openings in the ski boot. A disadvantage of this solution, however, is the need for the locking mechanism, which increases structural complexity and the weight of the ski binding. Moreover, manual actuation of the binding is necessary for locking purposes. However, in competitive sports in particular reducing the weight of the equipment and shortening the time needed to operate the equipment is of particular significance.

A need to improve further the binding system known from EP 0 199 098 A2 has also become apparent in the downhill mode for competitive downhill, in particular downhill racing. While the openings in the ski boot, in the form of conical recesses, allow the ski boot to slide reliably out of the binding in the event of a fall, to prevent injury to the skier, they do frequently result in undesirable misrelease during downhill skiing in the event of demanding maneuvers and the associated heavy loads between ski boot and ski, inevitably causing the skier to fall. To prevent such misrelease, the idea was mooted of locking the binding with the above-described locking mechanism even during downhill skiing, so as to prevent any release at all, and therefore indeed any misrelease. At the same time, however, this means that even in the event of a fall the binding is not released, which entails a significant risk of injury for the skier.

A locking system for a snow shoe is additionally known from EP 1 224 958 A1 with which a boot is held on the snow shoe so as to be pivotable. The locking system comprises two lateral bearing bolts, which engage in lateral openings in the boot conformed to the bearing bolts. The two bearing bolts are axially displaceable and pretensioned in the engaged position by a spiral spring and comprise actuating levers at their axial ends. This known arrangement makes use of the surface of the snow shoe available on either side of the boot in the case of snow shoes, unlike with skis, to fit the pins and their actuating mechanisms.

The object of the present invention is to provide a ski boot and a binding system for skis which may on the one hand be produced inexpensively and with low weight and on the other hand allow a simple and secure locking between ski boot and ski binding.

To achieve this object, according to a first aspect the invention provides a ski boot which comprises an opening in each of opposing lateral, front boot portions, the openings defining an opening axis along which bearing bolts of a ski binding may be introduced into the openings, in order to hold the ski boot on the ski binding such that it can pivot about the opening axis, at least one of the openings comprising at least one bearing portion, which is configured to come into bearing contact with a top and/or a bottom of the associated bearing bolt, in order to block the bearing bolt from sliding vertically out of the opening.

It should be noted at this point that in connection with the present disclosure, statements of direction such as "vertical", "horizontal", "sideways", "lateral", "top", "bottom", "front", "back" and the like should be understood from the point of view of the skier and relate to a ski boot which has been inserted in a downhill-ready operating position into a ski binding fitted to the ski, the ski resting on a horizontal plane and the skier standing upright in the ski boot.

In tests on conventional touring ski bindings it has been demonstrated that misrelease, in particular in competitive downhill skiing under elevated loading, is primarily caused by the bearing bolts sliding substantially vertically out of the openings in the ski boot In the conventional openings configured with conical walls, the tips of the bearing bolts slide along the upper or lower portions of the conical walls and the bearing bolts are urged against the spring force of the ski binding release mechanism simultaneously outwards and upwards or downwards, until they lose engagement with the openings, such that the ski boot is released. It has additionally be recognized that in the event of a fall forces primarily arise which tend towards twisting the ski boot relative to the ski about an axis vertical to the ski plane, such that the bearing bolts are urged along the conical walls horizontally forwards or backwards out of the openings.

In its first aspect, the invention takes account of this recognition, in that it modifies the design of the openings on the ski boot and deviates from the rotationally symmetrical, conical design of the openings according to the prior art, proposing instead at least one bearing portion which blocks the bearing bolts from sliding vertically out of the associated opening. Thus, inadvertent release of the binding may be prevented in particular during competitive downhill skiing even without any additional locking mechanism or locking of the locking mechanism. The ski boot may then reliably be used in particular also in racing and may be exposed to very high loads during travel without the risk of misrelease.

Preferably, at least one of the openings in the ski boot is defined horizontally (in the lengthwise direction of the ski up- and/or downstream of the opening) by a release portion which comprises a release surface extending obliquely to the opening axis, on which a bearing bolt introduced into the opening may slip and slide horizontally out of the opening. In such an embodiment on the one hand the frequency of the occurrence of vertical misrelease due to blocking of the bearing bolts is reduced, while on the other hand horizontal release continues to be possible, such that in the event of a fall, in particular if the skis twist relative to the ski boot, the ski boot may be released from the binding to prevent injuries to the skier.

In a preferred embodiment of the invention the at least one bearing portion may comprise a substantially horizontally extending bearing face. The bearing bolts may be supported against this horizontal, in particular planar bearing face when a force with a vertical component acts between bearing bolts and ski boot, such that the bearing bolts cannot slide vertically out of the opening. At the same time, on the occurrence of a substantially horizontal force between bearing bolts and ski boot, the bearing bolts are displaced along the horizontal bearing face and, for example in the event of the release portion being provided as mentioned above, slide horizontally forwards or backwards out of the opening.

Advantageously the opening may comprise an upper bearing portion and a lower bearing portion, wherein the opening may then be arranged between two mutually facing, substantially horizontally extending and in particular planar bearing faces of the bearing portions. In this way the bearing bolt is blocked from sliding both upwards and downwards out of the opening.

To achieve the object of the invention, according to a second aspect the invention further provides a ski boot which comprises an opening in each of opposing lateral, front boot portions, the openings defining an opening axis along which bearing bolts of a ski binding may be introduced into the openings, in order to hold the ski boot on the ski binding such that it can pivot about the opening axis, at least one of the openings comprising at least one inner bearing portion for bearing against an outer circumferential portion of the bearing bolt, the bearing portion allowing displacement of the bearing bolt in the direction of the opening axis and a pivoting movement of the bearing bolt about the opening axis, but substantially preventing displacement or a pivoting movement of the bearing bolt in other directions.

An important concept of the invention according to the second aspect accordingly likewise lies in tackling the problem of achieving release-safe locking between ski boot and ski binding by modifying the ski boot, instead of providing suitable locking means on the ski binding side, as is hitherto exclusively provided in the prior art. According to the invention the internal geometry of the lateral openings in the ski boot is modified such that an inner bearing portion is provided which may be supported against an outer circumferential portion of the bearing bolts introduced into the opening. The bearing portion is in this case arranged in accordance with the external geometry of the bearing bolt in such a way that it guides the bearing bolt in the direction of the opening axis and also allows a pivoting movement of the bearing bolt about the opening axis for normal use of the ski binding in the ski touring mode. At the same time, however, according to the second aspect of the invention bearing of the bearing portion against the bearing bolt prevents displacement of the bearing bolt in any other direction, i.e. transversely of the opening axis, and moreover prevents a pivoting movement of the bearing bolt about an axis other than the opening axis. Thus the bearing bolt cannot slide or be levered out of the opening even under transverse loading of the ski boot relative to the ski or the ski binding, such that the binding remains securely locked even in the event of elevated loads. This allows economies regarding the design effort and weight of a locking means on the ski binding and at the same time prevents unintentional loss of the ski during ascent.

As an alternative or in addition to the second aspect, the above-stated object of the invention according to a third aspect of the invention is achieved by a ski boot which comprises an opening in each of opposing lateral, front boot portions, the openings defining an opening axis along which bearing bolts of a ski binding may be introduced into the openings, in order to hold the ski boot on the ski binding such that it can pivot about the opening axis, at least one of the openings comprising at least one inner bearing portion for bearing against an outer circumferential portion of the bearing bolt, the bearing portion defining a cylindrical circumferential surface surrounding the opening axis.

According to the third aspect too, the problem of locking the binding system is thus solved by a special design of the internal geometry of the lateral openings by means of an inner bearing portion for bearing against an outer circumferential portion of the bearing bolt, wherein according to the third aspect the bearing portion defines a cylindrical circumferential surface surrounding the opening axis. The surrounding cylindrical circumferential surface inside the opening may form-fittingly enclose a substantially cylindrical outer circumference of the bearing bolt introduced into the opening, such that a transverse movement or tilting of the bearing bolt in the bearing portion is blocked and thus the bearing bolt cannot slide out of the opening in the event of transverse loading of the binding. Even with a non-cylindrical bearing bolt the openings according to the invention work advantageously together, for example with bearing bolts with a barrel-shaped outer circumferential surface, which is conformed to the interior bearing portions of the openings such that, although inadvertent release of the binding is prevented on lateral twisting of the ski boot, slight tilting of the bearing bolt for the purpose of the intentional opening and closure of the binding is possible without jamming.

In one preferred embodiment of the invention according to the second and/or third aspect, the bearing portion is formed by a cylindrical circumferential surface substantially completely surrounding the opening axis, such that the bearing portion may be produced with simple means for example by a bore and at the same time may completely enclose the bearing bolt in the circumferential direction about the opening axis and may thus secure it against tilting or slipping out of the opening. Variants are however likewise feasible in which the bearing portion comprises a plurality of separate bearing zones (bearing faces, bearing lines or bearing points) which ensure the above-described blocking of the bearing bolt against tilting or transverse displacement or are arranged relative to one another in such a way that they define a cylindrical circumferential surface surrounding the opening axis.

The at least one inner bearing portion of the opening should be configured such that the bearing bolt is supported axially over a length which is greater than or equal to half of the diameter of the bearing bolt in the region of its outer circumferential portion, preferably greater than or equal to the diameter of the bearing bolt in the region of its outer circumferential portion. For common dimensions of the bearing bolt it has been demonstrated in tests that said axial length, over which the bearing bolt is supported by the at least one inner bearing portion of the opening, should preferably be greater than 1 mm. Excessively small lengths may jeopardize the form-fitting hold of the bearing bolt and lead to inadvertent release of the binding on exposure of the ski boot to transverse load.

It is known per se to provide openings in generic ski boots in a metal insert which is integrated into a sole portion of the ski boot, such that the bearing points may be made from sufficiently stable material and thus be wear-resistant. In combination with a ski boot of the present invention, the use of an insert, in particular of a metal insert additionally makes it possible to achieve particularly stable and wear-resistant guidance of the bearing bolt, such that only said movements along or about the opening axis are possible. In particular, the sometimes considerable tilting moments, which are introduced in the event of transverse loading of the ski boot relative to the ski by the bearing bolt into the interior bearing portions of the openings, may be absorbed in a particularly stable and wear-resistant manner by the opening if the bearing portions are provided on such an insert, in particular of metal.

In a further preferred embodiment of the ski boot of the second aspect and/or of the third aspect of the invention, at least one opening has an admission surface at its mouth, over which a bearing bolt is displaceable in a direction extending transversely of the opening axis prior to entry into the opening, the admission surface guiding the bearing bolt to the opening axis. The features of this embodiment make it easier to get into the ski binding, the admission surface providing a positioning stop against which the user may rest the ski boot when getting into the binding and from which the bearing bolt slides reliably into the opening.

According to a fourth aspect of the invention, the above-stated object of the invention is achieved by a binding system comprising a ski boot according to the first and/or second and/or third aspect of the invention and a ski binding, the ski binding comprising two clamping levers which each comprise a bearing bolt which may be introduced into an associated one of the openings in the ski boot. The ski boot may here be configured according to one of the above described embodiments, in order also to provide the advantages and effects described in relation to the respective embodiment also for the binding system of the fourth aspect.

Particularly synergistic interplay arises between a ski boot according to the invention and a ski binding in which the clamping levers may be attached to the ski or to an element of the binding system, or are constructed firmly on the binding system, such that movement of the bearing bolts relative to the ski or the binding system is accompanied by elastic deformation of at least one of the clamping levers. Such a ski binding especially suitable for racing is extremely light and comprises the smallest possible number of components, since the clamping levers holding the bearing bolts are fitted directly and firmly on the ski and thus the entire opening and closing mechanism for pivoting movement of the clamping lever between the open and closed positions may be economized on. To get into the binding the clamping levers are bent outwards somewhat by the compressive force of the boot and/or by the manual exertion of additional force until the bearing bolts engage in the opening. To release the binding one of the levers is bent manually outwards, to which end the lever preferably comprises a gripping portion, in particular a gripping lever, by means of which the clamping lever may be moved manually until the bearing bolt has been withdrawn from the opening. Use of such a ski binding with a conventional ski boot with conventionally shaped openings would have the disadvantage that it would be scarcely be possible to prevent inadvertent release of the binding in ski touring mode, for example on the event of transverse loading of the binding on ascent, because of the resilience of the clamping lever necessary for opening and closing the binding. Known locking systems cannot be used for such a ski binding and in addition any weight gain and any additional operating effort needs to be avoided for specialized use in racing.

This problem too is solved surprisingly simply by a ski boot according to the invention by the special design of the openings, i.e. by providing the inner bearing portions for bearing on an outer circumferential portion of the bearing bolts. By guiding the bearing bolts in the opening, movement of the bearing bolts is restricted to movements along and about the opening axis and inadvertent release of the binding caused by transverse loading, i.e. tilting or transverse movement of the bearing bolts is reliably prevented. Tests carried out by the inventor have shown that, despite a certain resilience of the clamping levers, sliding of the bearing bolts out of the openings and thus inadvertent release of the binding may be prevented even under the relatively heavy loads which may arise in competitive ski touring.

In principle, the bearing bolts of the ski binding of the binding system could, according to the fourth aspect of the invention, exhibit an outer circumferential shape which differs from the cylindrical, provided that tilting of the bearing bolts in the openings, enabling the ski boot to slide out of the ski binding, is prevented. For instance, the bearing bolts could for example comprise a crowned or barrel-shaped outer circumferential portion, whereby the slight pivoting movement of the bearing bolts for opening or closing the ski binding is facilitated in the event of the skier getting intentionally out of or into the binding. However, in order particularly reliably to prevent unintentional release of the binding in the event of transverse loading of the ski boot, it is proposed that the bearing bolt should have a cylinder jacket-shaped outer circumference. This cylindrical surface may develop towards the tip into a conical surface tapering to a point.

In a further embodiment of the invention a binding system of the above-stated type in conjunction with a ski boot according to the first aspect of the present invention is proposed, the ski binding comprising a release mechanism which exerts a predetermined tension force on the clamping lever in a closed position of the ski binding, which tension force presses the bearing bolt into the associated openings in the ski boot, at least one of the openings in the ski boot being delimited horizontally (at the front and/or back) by a release portion and vertically by the bearing portion, wherein in a closed service position of the ski binding, on the action of a horizontal force between opening and bearing bolt introduced therein, which force extends horizontally and orthogonally to the opening axis and has an absolute value which is greater than or equal to a predetermined fall release force, the bearing bolt slides horizontally out of the opening against the tension force of the ski binding, and wherein in a closed service position of the ski binding, on the action of a vertical force between opening and bearing bolt introduced therein, which force extends vertically and orthogonally to the opening axis and has an absolute value which greater than or equal to the predetermined fall release force, the bearing bolt bears vertically against the bearing portion and is prevented from sliding out of the opening.

In this embodiment a release mechanism of the ski binding advantageously interacts with a ski boot of the first aspect of the invention, such that the ski boot is reliably released in the event of heavy sideways loading or of an elevated torque about a vertical axis, for example in the case of a fall, while misrelease caused by the bearing bolts sliding vertically out of the openings is prevented. The release mechanism of the ski binding may in this respect be provided by any means capable of exerting a predetermined tension force on the bearing bolts of the ski binding in the direction of engagement with the openings, this predetermined tension force determining the predetermined fall release force, which must act at least horizontally between the bearing bolt and the openings in the ski boot (horizontal and orthogonal to the opening axis) so that the bearing bolts slide horizontally out of the openings. When a force of comparable magnitude acts vertically, on the other hand release of the ski binding is prevented according to the invention by the at least one bearing portion.

Figure 2:
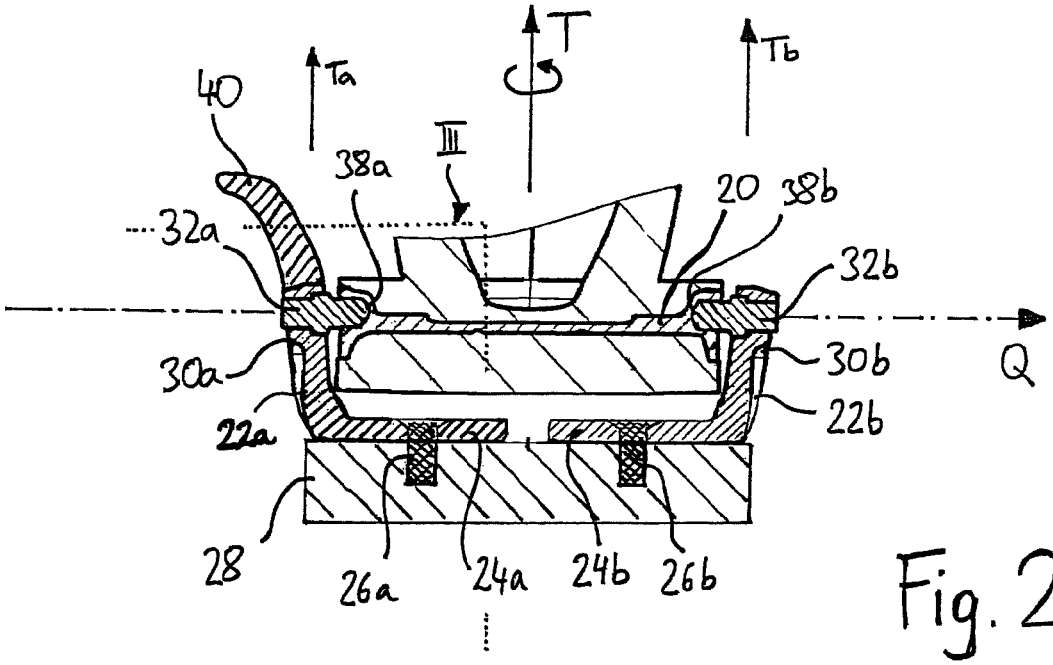
Figure 3:
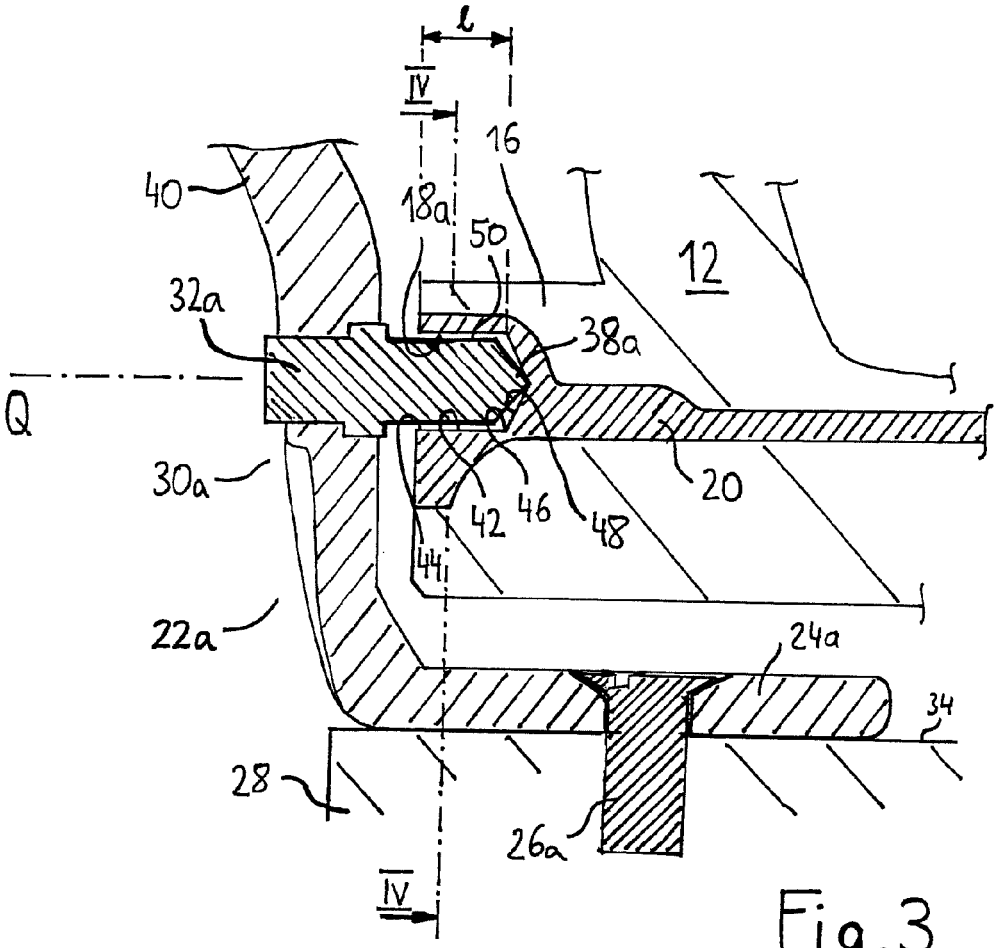
Figure 4A:
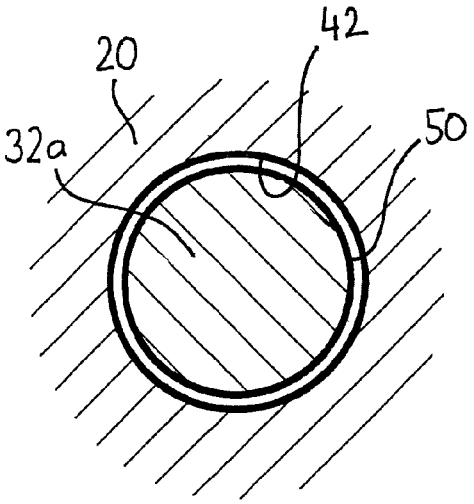
Figure 4B:
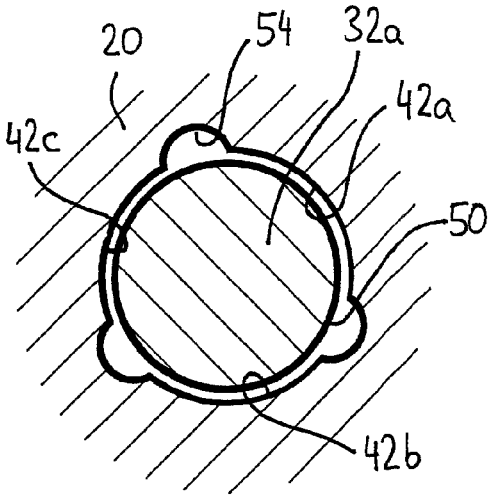
Figure 5:
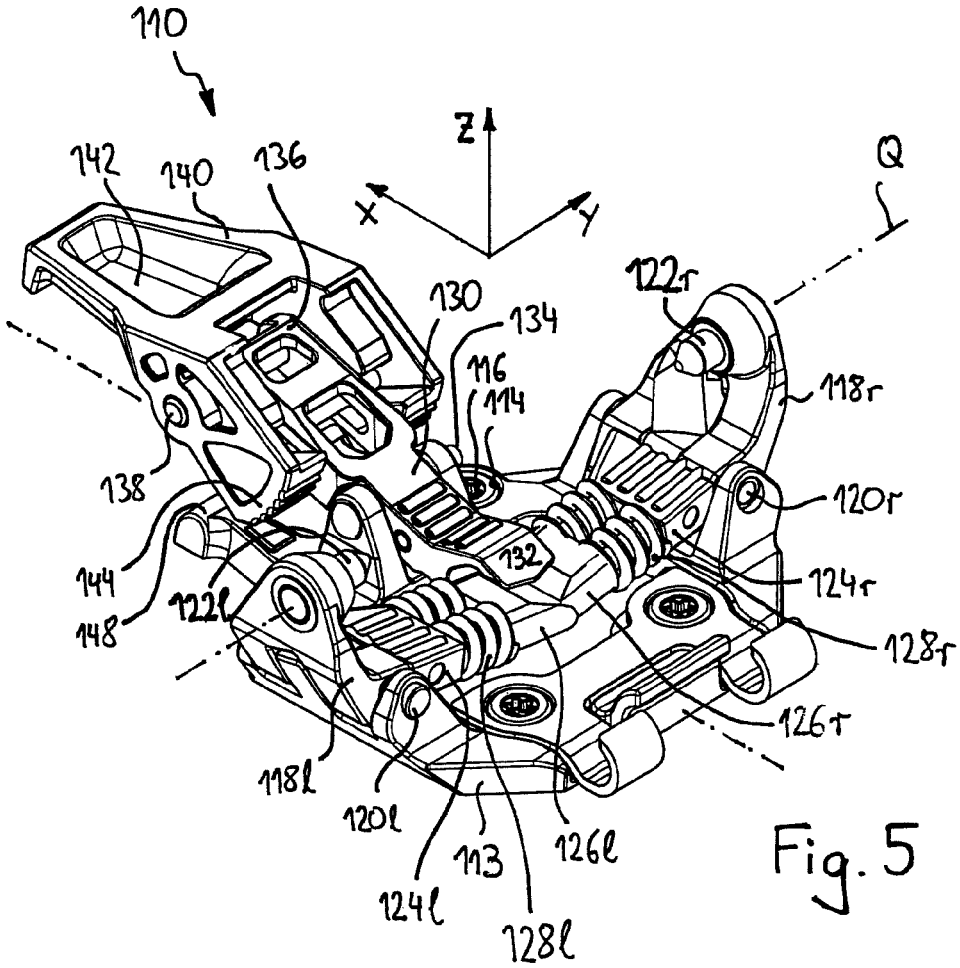
Figure 6:
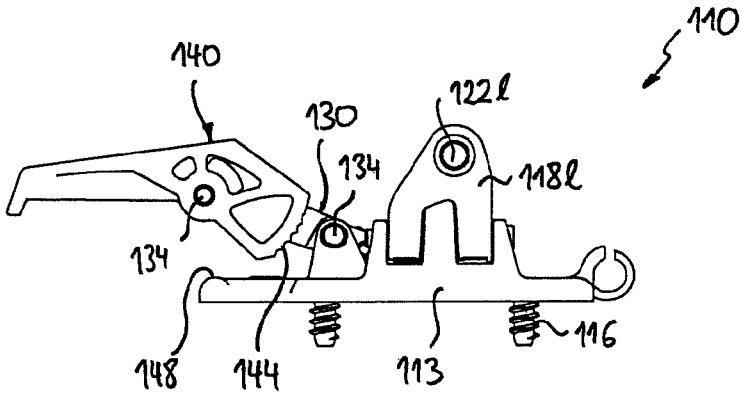
Figure 7:
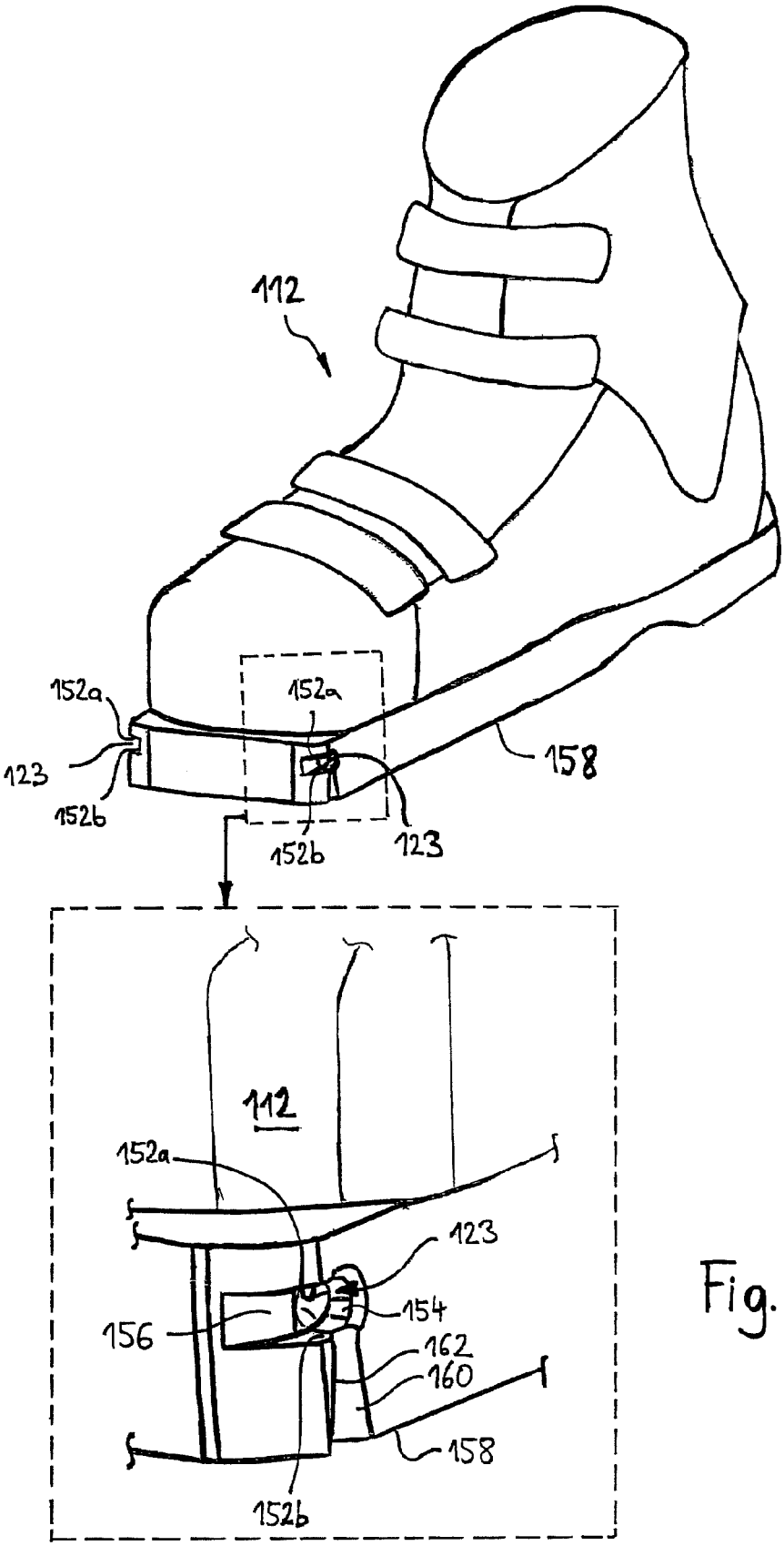
Figure 8:
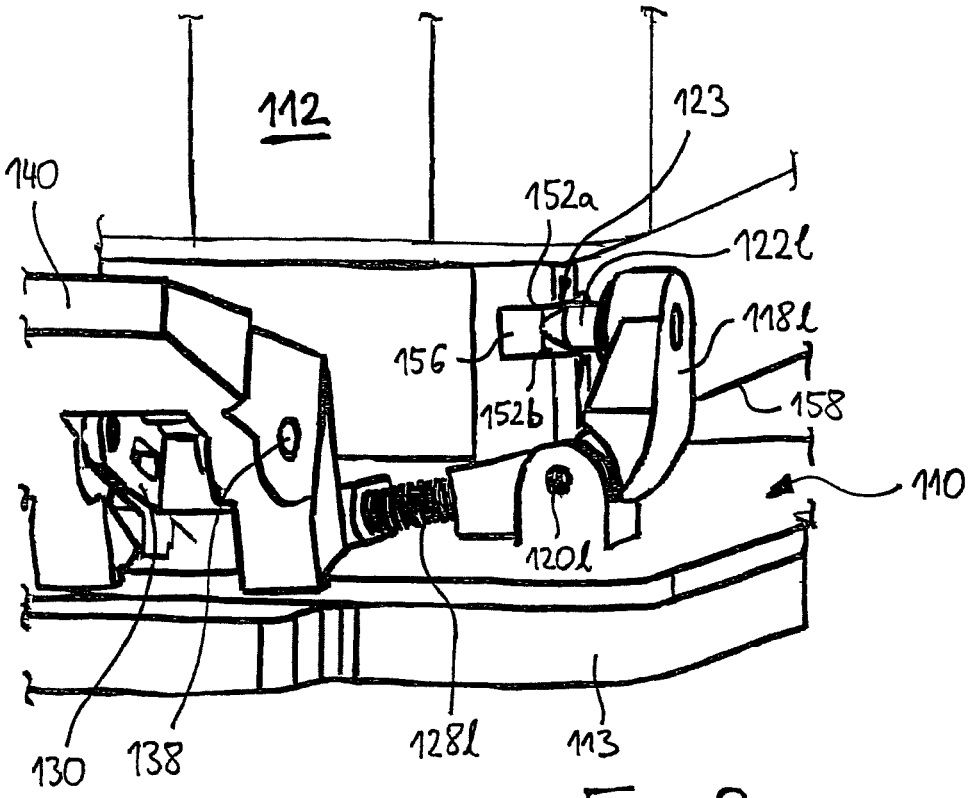

The invention is explained in greater detail below on the basis of preferred exemplary embodiments with reference to the attached drawings, in which:

FIG. 1 is a perspective view of a ski boot and of a binding system according to a first exemplary embodiment of the invention, FIG. 2 is a cross-sectional view of the ski boot and of the binding system of the first exemplary embodiment of the invention, FIG. 3 shows an enlarged portion III of FIG. 2, FIGS. 4*a* and 4*b* are cross-sectional views along a line IV-IV in FIG. 3 of two variant embodiments of the invention, FIG. 5 is a perspective view of a touring ski binding of a binding system according to a second exemplary embodiment of the invention, FIG. 6 shows a side view of the touring ski binding shown in FIG. 5, FIG. 7 is a perspective view of a ski boot of the binding system of the second exemplary embodiment of the invention, including an enlarged view of a front left portion of the ski boot, and FIG. 8 is an enlarged view of the binding system of the second exemplary embodiment of the invention in a roughly schematic representation, which illustrates the function of the binding system.

FIG. 1 shows a binding system 10 according to a first exemplary embodiment of the invention, comprising a ski boot 12 and a touring ski binding 14. Only a front portion of the ski boot 12 is shown in FIG. 1 for illustrative reasons. A sole 16 of the ski boot 12 comprises openings 18*a*, 18*b* respectively in opposing front lateral portions, the openings 18*a*, 18*b* extending along a common opening axis Q and being introduced from opposite sides into the sole 16 of the ski boot 12.

As is clear in particular from FIG. 2, the openings 18*a*, 18*b* are provided in a metal insert 20, which is incorporated, in particular cast, into the sole 16 of the ski boot 12, and extends between the openings 18*a*, 18*b* over the entire width of the front sole portion of the sole 16.

The touring ski binding 14 comprises two clamping brackets 22*a*, 22*b*, which are attached to a ski 28 by a bracket portion 24*a*, 24*b* by means of fixing screws 26*a*, 26*b*, and which each bear a bearing bolt 32*a*, 32*b* on their second bracket portions 30*a*, 30*b*. The bearing bolts 32*a*, 32*b* extend on a common axis, which, when in use, with the ski boot 12 inserted into the touring ski binding 14 and the bearing bolts 32*a*, 32*b* engaged in the openings 18*a*, 18*b*, coincides with the opening axis Q of the openings 18*a*, 18*b*, as shown in FIGS. 1 and 2. When the touring ski binding 14 is fitted to the ski 28, the common axis of the bearing bolts 18*a*, 18*b* extends substantially parallel to a surface 34 of the ski 28 and substantially orthogonal to a center axis M of the ski 28.

In the region of the mouth of each opening 18*a*, 18*b* the metal insert 20 widens radially of the opening axis Q and in each case forms an admission surface 36*a*, 36*b*. The boot widens gradually along the admission surfaces 36*a*, 36*b*, moving closer to the opening axis Q. When the skier gets into the touring ski binding 14 the ski boot 12 is brought up to the bearing bolts 32*a*, 32*b* in such a way that tapering tips 38*a*, 38*b* of the bearing bolts 32*a*, 32*b* firstly come into contact with the admission surface 36*a*, 36*b*. When pressure is exerted by the ski boot 12 in the direction of the bearing bolts 32*a*, 32*b*, the tips 38*a*, 38*b* of the bearing bolts 32*a*, 32*b* slip over the admission surfaces 36*a*, 36*b*, whereby the bearing bolts 32*a*, 32*b* and thus the second bracket portions 30*a*, 30*b* of the clamping brackets 22*a*, 22*b* are gradually forced outwards. The clamping brackets 22*a*, 22*b* are in this case bent resiliently outwards. This movement may be manually assisted, by gripping the second bracket portion 30*a* of the clamping bracket 22*a* by a gripping lever 40, which extends the second bracket portion 30*a* in an upwards direction, and likewise pushing it outwards.

When the bearing bolts 38*a*, 38*b* arrive sufficiently close to the opening axis Q, the bearing bolts 32*a*, 32*b* are inserted into the openings 18*a*, 18*b*, wherein they are pushed into the openings 18*a*, 18*b* and held therein under the pretension of the resiliently springing back second bracket portions 30*a*, 30*b*. To open the touring ski binding 14, i.e. to release the ski boot 12 from its engagement with the bearing bolts 32*a*, 32*b*, the gripping lever 40 is pushed manually outwards, such that the second bracket portion 30*a* of the clamping lever 22*a* again bends resiliently outwards and at the same time the bearing bolt 32*a* is withdrawn from the opening 18*a*.

Locking according to the invention of the engagement of the bearing bolts 32*a*, 32*b* in the openings 18*a*, 18*b* is described below with reference to FIGS. 3, 4*a*, and 4*b* by way of the example of the opening 18*a* or of the bearing bolt 32*a*. In the exemplary embodiment the second opening 18*b* is of like configuration to opening 18*a* and in particular comprises the same locking system, such that the description of the opening 18*a* may also be applied correspondingly to the second opening 18*b*.

As is clear from FIG. 3, the opening 18*a* comprises a cylinder jacket-shaped inner defining wall or cylindrical circumferential surface 42, which extends coaxially around the opening axis Q. The cylindrical circumferential surface 42 extends in the axial direction of the opening axis Q from a mouth 44 of the opening 18*a* over an axial length l of roughly . . . mm as far as an inner end portion 46 of the opening 18*a*, at which the cylindrical circumferential surface 42 develops into a conically recessed base surface 48. Such an opening 18*a* may simply take the form for example of a bore formed by means of a twist drill along the opening axis Q and in the exemplary embodiment is accommodated completely in the metal insert 20.

FIGS. 3 and 4*a* additionally show that the cylindrical circumferential surface 42 of the opening 18*a* is conformed to a cylindrical outer circumferential portion 50 of the bearing bolt 32*a*, in particular has a somewhat larger diameter than the bearing bolt 32*a* at its outer circumferential portion 50, such that the bearing bolt 32*a* sits in the opening 18*a* with a little play. At the free end of the bearing bolt 32*a* the cylindrical outer circumferential portion 50 develops into the conical tip 38*a*, the cone angle of which is smaller than the cone angle of the base surface 48 (at most is of equal magnitude), such that the tip 38*a* of the bearing bolt 32*a* rests virtually as a point against the deepest point of the base surface 48, so allowing minimum friction rotation between bearing bolt 32*a* and ski boot 12.

As a result of the above-described configuration of the inner boundary of the opening 18*a* in relation to the bearing bolt 32*a*, the bearing bolt 32*a* is guided form-fittingly into the opening 18*a* and may be displaced in the opening 18*a* substantially only along the opening axis Q or turned about the opening axis Q. Thus, the ski boot 12 may pivot forwards about the opening axis Q as a result of rotation between bearing bolts 32*a* and ski boot 12, in order for the binding system 10 to be used in ski touring mode. In addition, on actuation of the gripping lever 40 and bending outwards of the second bracket portion 30*a* of the clamping bracket 22*a*, the bearing bolt 32 may be withdrawn out of the opening 18*a* along the opening axis Q.

It should here be noted that the play between the bearing bolt 32*a* and the cylindrical circumferential surface 42 should be sufficiently great to allow the bearing bolt 32*a* to move strictly speaking on a large diameter circular path when opening the touring ski binding 14. At the same time, however, the cylindrical circumferential surface 42 of the opening 18*a* is conformed to the cylindrical outer circumferential portion 50 of the bearing bolt 32*a* to the extent that the ski boot 12 cannot be tilted or pivoted relative to the bearing bolt in such a way that the bearing bolt 32*a* slips out of the opening 18*a*.

If, in a specific situation of use, a transverse load acts on the ski boot 12, for example a torque about an axis T extending perpendicular to the surface 34 of the ski 28 (FIG. 2), the pins tilt 32*a*, 32*b* at most by a small angular amount in accordance with the play between their cylindrical outer circumferential portions 50 and the cylindrical circumferential surfaces 42 of the openings 18*a*, 18*b*, but are then held form-fittingly in the cylindrical circumferential surfaces 42. The forces then transmitted to the bearing bolts 32*a*, 32*b* may lead at most to the occurrence of a torque Ta or Tb in the second bracket portions 30*a*, 30*b* of the clamping brackets 22*a*, 22*b* about an axis orthogonal to the ski surface 34 or to a force extending parallel to the ski center axis M onto the second bracket portions 30*a*, 30*b*. Thus substantially no force or torque component acts to cause bending outwards of the second bracket portions 30*a*, 30*b*, i.e. to cause movement of the bearing bolts 32*a*, 32*b* out of the openings 18*a*, 18*b*. Consequently, the touring ski binding 14 remains reliably locked in place even if the ski boot 12 is exposed to transverse loading.

FIG. 4*b* shows a variant embodiment of the invention in a sectional representation corresponding to FIG. 4*a*, hereinafter only the differences from the variant embodiment of FIGS. 1 to 3, 4*a* being explained and reference expressly being made in relation to the remaining configuration to the description in FIGS. 1 to 3, 4*a*, which is also valid for the second variant embodiment.

In the second variant embodiment the opening 18*b* is not defined by a completely surrounding cylindrical circumferential surface, but rather comprises three separate bearing portions 42*a*, 42*b*, 42*c*, which each form circumferential portions of a cylindrical circumferential surface surrounding the opening axis Q and are separated from one another by axial grooves 54. The grooves 54 may accommodate snow, which is displaced out of the opening 18*b* on introduction of the bearing bolt 32*b*.

The width of the grooves 54 in the circumferential direction of the imaginary cylindrical circumferential surface is markedly smaller than the diameter of the bearing bolt 32*b*, such that the bearing bolt 32*b* is supported form-fittingly and securely against the bearing portions 42*a*, 42*b*, 42*c* at any load angle and thus movement of the bearing bolts 32*b* is possible only about or along the opening axis Q. Despite the interruption of the closed cylindrical circumferential surface by the grooves 54, the bearing portions 42*a*, 42*b*, 42*c* thus define a cylindrical circumferential surface surrounding the opening axis Q due to their shaping which is conformed to the outer circumferential portion 50 of the bearing bolt 32.

The first exemplary embodiment is not limited to the above-stated variant embodiments. For example, conceivable to a person skilled in the art are further forms of bearing portions within the openings 18*a*, 18*b* with which the bearing bolts 32*a*, 32*b* may be suitably guided or supported, such that the latter may move substantially only along and about the opening axis Q of the openings 18*a*, 18*b*. For instance, the openings 18*a*, 18*b* could also have an angular cross-section, for example a square cross-section, instead of a substantially circular cross section.

A second exemplary embodiment of the invention will be explained with reference to FIGS. 5 to 8. A binding system of the second exemplary embodiment comprises a touring ski binding 110 and a ski boot 112 fittable thereto.

A base portion 113 of the touring ski binding 110 comprises fastening means for fastening the touring ski binding 110 to the surface of a ski, not shown. The fastening means may be formed of a plurality of holes 114, through which may be guided screws 116 which can be screwed into the ski. The fastening means define a position for mounting the touring ski binding 110 on a touring ski and thus define an X direction along a horizontal longitudinal axis L, which corresponds to a lengthwise ski axis, a Y direction, which extends horizontally and orthogonally to the X direction, and a Z direction, which extends vertically, i.e. orthogonally to the X direction and to the Y direction.

On the base portion 113 a left-hand bearing bracket 118*l* and a right-hand bearing bracket 118*r* are mounted on different sides of a vertical central plane, containing the lengthwise axis L and extending parallel to the Z direction, through pivot pins 120*l*, 120*r* extending in each case in the X direction. At their upper free ends the bearing brackets 118*l*, 118*r* comprise bearing bolts 122*l*, 122*r*, which together define a pivot pin for the ski boot 112 extending transversely of the X direction and which are arranged to come into engagement with corresponding openings 123 in front lateral portions of a sole region of the ski boot 112, in order to hold the ski boot 112 on the touring ski binding 110 so as to be pivotable about the common pivot axis.

Actuating arms 1241, 124*r* of the bearing brackets 118*l*, 118*r* at a distance from the bearing bolts 122*l*, 122*r* extend substantially towards one another and are in contact with one another at end caps 126*l*, 126*r* of the actuating arms 1241, 124*r*. The length of the actuating arms 1241, 124*r* from their respective pivot pins 120*l*, 120*r* as far as the end caps 126*l*, 126*r* may be varied by mobile mounting of the end caps 126*l*, 126*r* in relation to the bearing brackets 118*l*, 118*r*. Tension springs 128*l*, 128*r* act in each case between the end caps 126*l*, 126*r* and the bearing brackets 118*l*, 118*r*, in order to pretension the end caps 126*l*, 126*r* into contact with one another. In this way, the tension springs 128*l*, 128*r* hold the bearing brackets 118*l*, 118*r* in two stable states, namely a first state, in which the contact point between the end caps 126*l*, 126*r* is arranged under a connecting line between the pivot pins 120*l*, 120*r*, such that the bearing bolts 122*l*, 122*r* are pretensioned by the tension springs 128*l*, 128*r* to bring them closer together and are tensioned into engagement with the counter-bearing elements of the ski boot, and a second state, in which the contact point between the end caps 126*l*, 126*r* is arranged above a connecting line between the pivot pins 120*l*, 120*r*, such that the bearing brackets 118*l*, 118*r* are tensioned in the opposite direction, such that the two bearing bolts 122*l*, 122*r* are urged away from one another and release the ski boot. The first state forms a closed position of the touring ski binding 110, while the second state corresponds to an open position of the touring ski binding 110.

In a manner known per se, the pivoting movement of the bearing brackets 118*l*, 118*r* between the closed position and the open position may be coupled with a pivoting movement of an actuating lever 130, in that a first end 132 of the actuating lever 130 is coupled for movement with the two end caps 126*l*, 126*r*, and the actuating lever 30 is mounted pivotably on the base portion 113 on a bearing pin 134 extending transversely of the X direction, such that a pivoting movement of the lever 130 about the bearing pin 134 is converted into a substantially vertical movement of the two end caps 126*l*, 126*r* and thus a pivoting movement of the bearing brackets 118*l*, 118*r* about the pivot pins 120*l*, 120*r*. On the other hand, the coupling between the actuating lever 130 and the end caps 126*l*, 126*r* leads to a pivoting movement of the bearing brackets 118*l*, 118*r* being converted into a pivoting movement of the lever 130.

At a second end 136 of the actuating lever 130 a locking lever 140 is mounted pivotably about a pivot pin 138 extending transversely of the X direction, in particular substantially in the Y direction, such that said locking lever 140 is pivotable between an unlocked position (downhill position) shown in FIGS. 5 and 6 and a locked position (walking position) not shown in the figures. By means of an operating portion 142 the locking lever 140 may be actuated manually by the skier's hand or the tip of a ski pole, to move the locking lever 140 between the unlocked position and the locked position. In addition, the locking lever comprises a locking portion 144, which blocks pivoting movement of the actuating lever 130 in the locked position of the locking lever 140 and allows the pivoting movement of the actuating lever 130 in the unlocked position.

In FIGS. 5 and 6 the touring ski binding 110 is shown in each case in the closed position, in which the ski boot 112 is engaged with the bearing bolt 122*l*, 122*r* when the binding is in use. If the locking lever 140 according to FIGS. 5 and 6 is pivoted into the unlocked position, the locking lever 140 bears against a limit stop on the actuating lever 130. Further actuation of the locking lever 140 towards the unlocked position is thus converted into pivoting actuation of the actuating lever 130 about the bearing pin 134, such that the first end 132 of the actuating lever 130 moves the end caps 126*l*, 126*r* upwards and the bearing brackets 118*l*, 118*r* are pivoted outwards, in order to adjust the touring ski binding 110 into the open position.

Conversely, in the unlocked, closed position according to the Figures a release mechanism of the touring ski binding 110 may become active, which is formed by the bearing brackets 118*l*, 118*r* with the tension springs 128*l*, 128*r*, the actuating lever 130 and the locking lever 140. On release of the touring ski binding 110, to be described in greater detail below, the bearing brackets 118*l*, 118*r* are pivoted outwards against the tension of the tension springs 128*l*, 128*r*. The forced movement of the bearing brackets 118*l*, 118*r* on release leads to a forced pivoting movement of the actuating lever 130.

As is visible in FIGS. 5 and 6, on release of the touring ski binding 110 a release movement of the actuating lever 130 (here a downwards movement of the second end 136 of the actuating lever 130 towards the ski) is possible, since the locking portion 144 of the locking lever 140 does not block this pivoting movement. If, on the other hand, the locking lever 140 is pivoted into the locked position (clockwise in FIG. 6), the locking portion 144 moves onto a portion fixed to the binding or ski, here a projection 148 of the base portion 113, such that the actuating lever 130 is blocked and held in a locked position. Even on exposure to a high level of force between ski boot 112 and touring ski binding 110, which would lead in the unlocked position to release of the touring ski binding 110, the actuating lever 130 is also no longer able to pivot into the open position, such that the bearing bolts 122*l*, 122*r* are also no longer able to be released from engagement with the openings 123 in the ski boot 112. Release can then only take place if a significantly greater locking release force is exceeded, e.g. due to elastic deformation of the clamping brackets 118*l*, 118*r* or of the actuating lever 130, or release is no longer possible at all without damage to the binding or to the boot. In this locked position the touring ski binding 110 may be used in particular for mountain ascents, when release is not needed for safety reasons and indeed any release needs to be prevented.

As described above, in the locked position of the touring ski binding 110 a release mechanism is provided, by the pivotable mounting of the bearing brackets 118*l*, 118*r* and the force of the tension springs 128*l*, 128*r*, which urges the bearing bolts 122*l*, 122*r* with a predetermined tension force into the openings 123 in the ski boot 112. The predetermined tension force is in this case determined to a considerable extent by the tension force of the tension springs 128*l*, 128*r*. As a function of the geometry of the openings 123 in the ski boot, in particular the shaping of the walls of the openings 123, the release mechanism may work in such a way that, on exertion of a force between ski boot and touring ski binding 110 which exceeds a predetermined fall release force, the bearing bolts 122*l*, 122*r* slip along the walls of the openings 123 and are simultaneously urged outwards, i.e. out of the openings 123, the latter movement taking place against the tension force of the release mechanism, in particular against the tension force of the tension springs 128*l*, 128*r*. The predetermined tension force of the release mechanism thus defines a predetermined fall release force, which has to act between ski boot 112 and touring ski binding 110, so that the bearing bolts 122*l*, 122*r* slide out of the openings 123 in the ski boot 112 and the touring ski binding 110 is released.

According to the invention this release is restricted, however. The following configuration of the opening 123 in the ski boot 112, described with reference to FIGS. 7 and 8, namely allows the bearing bolts 122*l*, 122*r* to slide out substantially only horizontally, while release in the vertical direction is blocked. Where the present disclosure mentions blocking or release in the vertical direction, this should be understood to mean a movement or force in a direction which has a not insignificant vertical component, preferably a direction which forms an angle <45° with the vertical Z axis. Accordingly, release, action of a force or movement in the horizontal direction should be understood to mean a corresponding action in a direction which comprises a not insignificant component in the horizontal direction, i.e. in the X direction, preferably a direction which forms an angle of <45° with the X direction.

FIG. 7 shows a front left-hand portion of the ski boot 112 in the region of the left-hand opening 123, which is intended for engagement with the left-hand bearing bolt 122*l*. A corresponding right-hand opening 123 is formed in the front right-hand portion of the ski boot 112. Both openings 123 are introduced, preferably as blind holes, into the ski boot from the outside along a common opening axis Q extending in the Y direction. The opening axis Q coincides with the above-mentioned pivot axis, about which the ski boot 112 is mounted pivotably on the bearing bolts 122*l*, 122*r* of the touring ski binding 110.

At its top the opening 123 is defined by an upper bearing portion 152*a* in the form of a substantially horizontal, flat, downwards pointing surface, while at its bottom the opening 123 is defined by a lower bearing portion 152*b* in the form of a substantially horizontal, flat, upwards pointing surface. The opening 123 is thus located between two flat planes extending substantially parallel to one another of the bearing portions 152*a* or 152*b*.

In the X direction the opening 123 is defined by a rear wall 154 in the shape of a portion of a cylinder, which wall is defined by a cylinder concentric to the opening axis Q. The rear wall 154 preferably extends so far around the opening axis Q that it merges at the top with the surface of the upper bearing portion 152*a* and at the bottom with the surface of the lower bearing portion 152*b*.

In the X direction the opening 123 is additionally defined at its front by a release surface 156, which extends forwards obliquely of the opening axis Q. In the exemplary embodiment the release surface 156 is defined at the top and bottom by the surfaces of the upper and lower bearing portions 152*a*, 152*b* respectively. The release surface 156 thus forms the bottom of a groove extending in the X direction, the groove walls of which are formed by the upper and lower bearing portions 152*a*, 152*b* and the depth of which increases in a rearwards direction over the course of the groove.

An admission portion 160 in the form of a groove 162 extending substantially in the Z direction additionally extends between the opening 123 and a sole 158 of the ski boot 112. The groove 162 is open towards the sole 158, such that on insertion of the ski boot 112 into the binding the ski boot 112 may be guided onto the bearing bolts 122*l* from above, until the bearing bolt 122*l* penetrates from the sole 158 into the groove 162. The groove 162 leads to the opening 123 and in so doing passes through the lower bearing portion 152*b*.

In the region of the groove 162 the lower bearing portion 152*b* may be relieved somewhat in accordance with the shape of the groove 162 (FIG. 7), such that the width of the surface of the lower bearing portion 152*b* is reduced somewhat in the Y direction, wherein however the surface of the lower bearing portion 152*b* also has a minimum width in the Y direction in the region of the groove 162, in order to prevent the bearing bolt 122*l* from sliding vertically downwards out of the opening 123. Alternatively the depth of the groove 162 may fall away to zero from the sole 158 to the surface of the lower bearing portion 152*b*, such that the width of the surface of the lower bearing portion 152*b* in the Y direction is not impaired by the groove 162.

When the touring ski binding 110 is in operation the bearing bolt 122*l* enters into engagement with the opening 123, as illustrated in FIG. 8. For downhill skiing the touring ski binding 110 is placed into the unlocked position, in which both bearing bolts 122*l*, 122*r* are pretensioned by the tension force of the tension springs 128*l*, 128*r* into the respective openings 123 on both sides of the ski boot 112. The locking lever 40 is in this case pivoted into the unlocked position according to FIGS. 5 and 6, such that it does not block a spreading movement of the clamping brackets 118*l*, 118*r* against the tension of the tension springs 128*l*, 128*r*, i.e. allows fall release.

If a torque about the Z axis then acts between ski boot 112 and touring ski binding 110 during downhill skiing, for example in the event of a fall by the skier, which torque twists the ski boot 112 in relation to the ski in a counterclockwise direction when viewed from above, this leads to the action of a force in the X direction (horizontal action of force) between the left-hand bearing bolt 122*l* and the left-hand opening 123, whereby the bearing bolt 122*l* is urged horizontally towards the front release surface 156. If this force is greater than a predetermined fall release force, which depends on the gradient of the release surface 156 and on the tension force of the tension springs 128*l*, 128*r*, the bearing bolt 122*l* slips over the release surface 156 and in so doing urges the bearing bolt 122*l* against the pretension of the tension springs 128*l*, 128*r* out of the opening 123, until the bearing bolt 122*l* slips forwards off the release surface 156 and the ski boot 112 is released from the touring ski binding 110. If, on the other hand, the above-described force in the X direction is less than the predetermined fall release force, the tension force of the tension springs 128*l*, 128*r* holds the bearing bolt 122*l* in engagement with the opening 123.

If, in another case, when the touring ski binding 110 is in the downhill position, a torque or force acts between the ski boot 112 and the touring ski binding 110 in such a way as to force the bearing bolt 122*l* inserted into the opening 123 in the Z direction upwards or downwards or obliquely upwards or obliquely downwards (vertical action of force), the top or the bottom of the bearing bolt 122 impacts against the upper bearing portion 152*a* or the lower bearing portion 152*b* and is blocked thereby. Since the bearing portions 152*a*, 152*b* in each case comprise substantially horizontally extending bearing faces, the bearing bolt 122*l* cannot slip over these surfaces in such a way as to be urged out of the opening 123. Even if the force acting in the Z direction is greater in magnitude than the above-mentioned fall release force, i.e. even when the vertical force is of such magnitude that a force of the same magnitude in the X direction would bring about release of the bearing bolt 122*l* via the front release surface 156, the touring ski binding 110 remains securely locked under the action of vertical force and inadvertent misrelease may be prevented.

If a torque acts on the ski boot which twists the ski boot clockwise relative to the ski when viewed from above, the bearing bolt 122*l* is pressed against the rear wall 154, in the shape of a portion of a cylinder, of the opening 123 and there likewise blocked, such that its cannot slide out of the opening 123. At the same time, however the right-hand bearing bolt 122*r* is forced forwards in the right-hand opening 123, of corresponding symmetrical configuration, of the ski boot and slides over the corresponding right-hand release surface (modeled on the release surface 156) out of the right-hand opening 123, such that the touring ski binding 110 is likewise released.

It is apparent from the above description in relation in particular to FIG. 8 that in the binding system of the second exemplary embodiment of the invention the bearing bolt 122*l* is limited in movement between the upper bearing portion 152*a* and the lower bearing portion 152*b*, such that it is able to exit from the opening 123 only along the opening axis Q, forwards in the X direction or in a direction extending between opening axis Q and X direction. Release of the ski boot in the vertical direction, which has been identified as the main cause of inadvertent release in competitive downhill skiing, is thus significantly impeded, while, in the event of torsion between ski boot 112 and ski about an axis of rotation in the X direction arising generally under fall conditions, release may occur reliably in that the bearing bolt 112*l* slides forwards in the X direction out of the opening 123. In this way the binding system is also suitable for competitive skiing while simultaneously offering a minimum of safety.

The invention claimed is:

1. A ski boot comprising:

an opening in each of opposing lateral, front boot portions, wherein the openings define an opening axis along which at least one bearing bolt of a ski binding is introducible into at least one of the openings along the opening axis, in order to hold the ski boot on the ski binding such that the ski boot can pivot about the opening axis wherein at least one of the openings comprises at least one inner bearing portion for bearing against an outer circumferential portion of the at least one bearing bolt, wherein the at least one inner bearing portion defines a cylindrical circumferential surface surrounding the opening axis, wherein the at least one inner bearing portion of the at least one opening is configured such that the at least one bearing bolt is supported axially over a length which is greater than 1 mm, wherein the cylindrical circumferential surface develops into a base surface, wherein the openings are respectively provided in opposing front lateral portions of the ski boot and are introduced from opposite outer sides into the ski boot, and wherein at least one of the openings is formed in an insert which is integrated into a sole portion of the ski boot.

2. The ski boot according to claim 1, wherein the at least one bearing portion is formed by a cylindrical circumferential surface substantially surrounding the opening axis.

3. The ski boot according to claim 1, wherein at least one of the openings comprises an admission surface at its mouth, over which the at least one bearing bolt is displaceable in a direction extending transversely of the opening axis prior to entry into the at least one opening, and wherein the admission surface is configured to guide the at least one bearing bolt to the opening axis.

4. A binding system, comprising a ski boot as claimed in claim 1 and a ski binding, wherein the ski binding comprises two clamping levers, which each comprise a bearing bolt, which may be introduced into an associated one of the openings in the ski boot.

5. The binding system as claimed in claim 4, wherein the clamping levers are attached to the ski or to an element of the binding system or are constructed firmly on the binding system, and wherein movement of the bearing bolts in relation to the ski or the binding system for adjusting the ski binding between closed position and open position is accompanied by elastic deformation of at least one of the clamping levers.

6. The binding system as claimed in claim 4, wherein at least one of the two clamping levers comprises a gripping portion, in particular a gripping lever, by means of which the clamping lever may be moved manually in order to move the bearing bolt of the clamping lever in the opening direction.

7. The binding system as claimed in claim 4, comprising a ski boot and a ski binding, wherein the ski binding comprises two clamping levers, which each comprise a bearing bolt, which may be introduced into an associated one of the openings in the ski boot wherein the ski binding also comprises a release mechanism, which exerts a predetermined tension force on the clamping lever in a closed position of the ski binding, which tension force presses the bearing bolts into the associated openings in the ski boot, wherein at least one of the openings in the ski boot is delimited horizontally by a release portion and vertically by the bearing portion, wherein in a closed service position of the ski binding, on the action of a horizontal force between opening and bearing bolt introduced therein, which force extends horizontally and orthogonally to the opening axis and has an absolute value which is greater than or equal to a predetermined fall release force, the bearing bolt slides horizontally out of the opening against the tension force of the ski binding, and wherein in a closed service position of the ski binding, on the action of a vertical force between opening and bearing bolt introduced therein, which force extends vertically and orthogonally to the opening axis and has an absolute value which is greater than or equal to a predetermined fall release force, the bearing bolt bears vertically against the bearing portion and is prevented from sliding out of the opening.

8. The ski boot according to claim 1, wherein the at least one bearing portion is formed by a cylindrical circumferential surface substantially surrounding the opening axis.

9. The ski boot according to claim 1, wherein the insert is a metal insert.

10. The ski boot according to claim 1, wherein the at least one inner bearing portion is configured to allow displacement of the at least one bearing bolt in the direction of the opening axis and a pivoting movement of the at least one bearing bolt about the opening axis, and wherein the at least one inner bearing portion is configured to substantially prevent displacement or a pivoting movement of the at least one bearing bolt in other directions.

11. The ski boot according to claim 1, wherein the at least one bearing portion is configured to come into bearing contact with a top and/or a bottom of the associated at least one bearing bolt, in order to block the at least one bearing bolt from sliding vertically out of the opening.

12. The ski boot according to claim 11, wherein at least one of the openings is defined horizontally by a release portion which comprises a release surface extending obliquely to the opening axis, on which the at least one bearing bolt introduced into the at least one opening is permitted to slip and slide horizontally out of the at least one opening.

13. The ski boot according to claim 11, wherein the at least one bearing portion comprises a substantially horizontally extending bearing face.

14. The ski boot according to claim 11, wherein at least one of the openings is arranged between two mutually facing, substantially horizontally extending bearing faces.

* * * * *